US009242843B2

(12) United States Patent
Nkwantabisa

(10) Patent No.: US 9,242,843 B2
(45) Date of Patent: Jan. 26, 2016

(54) FUNNEL FOR TRANSFERRING FLUIDS

(71) Applicant: Joseph Nkwantabisa, Columbus, OH (US)

(72) Inventor: Joseph Nkwantabisa, Columbus, OH (US)

( * ) Notice: Subject to any disclaimer, the term of this patent is extended or adjusted under 35 U.S.C. 154(b) by 7 days.

(21) Appl. No.: 14/082,104

(22) Filed: Nov. 16, 2013

(65) Prior Publication Data

US 2015/0136274 A1 May 21, 2015

(51) Int. Cl.
*B67C 11/02* (2006.01)

(52) U.S. Cl.
CPC ..... *B67C 11/02* (2013.01); *B67C 2011/027* (2013.01)

(58) Field of Classification Search
CPC .. B67C 11/00; B67C 11/02; B67C 2011/027; B67C 9/00; B65B 39/06
USPC ..... 141/331–343, 363–366, 86–88, 391, 141/106; 184/1.5, 105.1
See application file for complete search history.

(56) References Cited

U.S. PATENT DOCUMENTS

| | | | | | |
|---|---|---|---|---|---|
| 3,643,704 | A * | 2/1972 | Carr | 141/106 |
| 4,271,878 | A * | 6/1981 | Bologa | 141/375 |
| 4,389,926 | A * | 6/1983 | Joyner | 99/495 |
| 4,832,095 | A * | 5/1989 | Bonnell | 141/106 |
| 5,269,354 | A * | 12/1993 | Koberg | 141/106 |
| 5,385,180 | A * | 1/1995 | Wittman | 141/340 |
| 5,758,804 | A * | 6/1998 | Wirth | 222/460 |
| 5,775,651 | A * | 7/1998 | Jackovich | 248/213.2 |
| 5,899,246 | A * | 5/1999 | Cummins et al. | 141/297 |
| 6,425,424 | B1 * | 7/2002 | Ellis Calvo et al. | 141/331 |
| 7,461,542 | B2 * | 12/2008 | Weisinger | 73/54.13 |
| D697,540 | S * | 1/2014 | Nkwantabisa | D15/150 |
| 2012/0267006 | A1 * | 10/2012 | Liao | 141/331 |
| 2014/0345746 | A1 * | 11/2014 | Flynn | B67D 7/06 141/20.5 |
| 2015/0129085 | A1 * | 5/2015 | Everett | B67C 11/02 141/337 |

* cited by examiner

*Primary Examiner* — Timothy L Maust
*Assistant Examiner* — Timothy P Kelly
(74) *Attorney, Agent, or Firm* — Bryce D. Miracle; Miracle IP

(57) ABSTRACT

A funnel with the ability to receive and secure one or more inverted source containers for transferring fluids to a receiving container, without requiring the assistance of a user.

5 Claims, 12 Drawing Sheets

FUNNEL FOR TRANSFERRING FLUIDS

BACKGROUND

This disclosure relates to a device for use in transferring fluids from a source container to a receiving container. In one of its more specific versions, the invention relates to a device for use in dispensing oil from oil containers to an oil fill port.

At one time or another almost every individual who owns a vehicle or lawn mower with an internal combustion engine has had the experience in which they have had to pour fluids, such as gasoline or oil from a can to a port or other filler opening. Normally, a conventional funnel is utilized to facilitate the transfer of fluid from the source container to the receiving container in an effort to reduce spillage.

Conventional oil funnels are provided with a bowl-shaped receiving portion defining an opening which tapers towards a nozzle which is inserted within the filler opening of the receiving container or the oil fill port of the engine block. The opening and nozzle portions are typically of various shapes and sizes, and are systematically unstable and inconsistent when utilized. For example, when adding oil to a combustible engine, the user must first place the conventional funnel into the oil port of the engine. Sometimes the oil port can be placed in a hard to reach place compounding the awkwardness of effectively pouring oil manually by hand into the funnel. Frequently, when the user initially pours the oil from the container, the forceful flow of the fluid contacting the funnel will shift the position of or even worse, knock the funnel over and out of the fluid receiver resulting in spillage. In some instances, overflows are only an inconvenience, however, in others, such as where hydrocarbon fuels are being added to vehicles, the spill results in environmental contamination and a waste of natural resources.

Moreover, some funnel users have a difficult time accurately holding, aiming and pouring the fluid until the fluid is exhausted from the container to the funnel, further resulting in spillage of the fluid. The entire process can take up to several minutes. Furthermore, conventional funnels typically limit users as to the number of containers they are able to pour at the same time, resulting in a process that is laborious and time consuming.

SUMMARY

For the foregoing reasons, what is needed is a funnel that is easily and securely inserted into a receiving container which has the ability to securely hold an inverted source container in the inverted position, whereby fluids can freely flow into the funnel and fill the receiving container. This provides hands free operation of the funnel allowing the user to simultaneously achieve other tasks while being ensured that the liquid material is not spilled, yet efficiently and reliably transferred to the receiving container such as a gas tank or oil reservoir.

In accordance with the invention, a funnel for transferring fluids from one or more source containers to a receiving container is provided. The funnel comprises a receiving platform near the top of the funnel, the receiving platform has a circular aperture with a perimeter adapted to receive and hold the neck portion of an inverted source container, wherein the inverted source container is held securely in the inverted position. While in this position, the fluid within the source container flows freely into the funnel without external assistance by the user.

In a version of the invention, the circular aperture comprises a means for gripping the neck portion of an inverted source container such as a plurality of independently flexible gripping tabs positioned around the perimeter of the circular aperture. When the neck portion of the inverted source containers is inserted into the circular aperture, the plurality of independently flexible gripping tabs flex in order to receive and grip the neck portion of the source container, therefore holding the source container in a stable manner—which ensures the accuracy of the fluid flowing into the funnel.

Preferably, the funnel further includes a cylindrical wall that extends perpendicularly above and around the means for gripping the neck portion of an inverted source container. The cylindrical wall assists in guiding the neck portion of the inverted source container into the means for gripping and also provides increased support about the neck portion of the inverted source container while the source container is engaged with the funnel.

In another version of the invention, the receiving platform partially extends above the top of the funnel forming an upper opening. The upper opening is configured to provide an opening for receiving a poured fluid from a source container. This provides the user with the ability to manually pour an additional source container at the same time as another source container is securely inserted and dispensed into the circular aperture as described above. Therefore, the user saves time by pouring more than one source container at the same time. Optionally, the outer surface of the funnel may have a gap which merges with the upper opening forming a slot for inserting and seating yet another inverted source container—such as a standard sized quart of oil—which provides the ability to transfer fluids from two source containers simultaneously without external or manual assistance by the user.

In yet another version of the invention, a funnel is provided which has a lower distribution portion. The lower distribution portion has an elongated tubular neck portion having a discharge end. The elongated neck portion has an encompassing external ledge near the discharge end for gripping and catching on the internal surfaces of a receiving container such as on the inner ledge of an oil port.

Preferably, the encompassing external ledge is created by the elongated tubular neck portion having an upper diameter and a larger lower diameter. The lower diameter defines a cylindrical nozzle with the encompassing external ledge formed by the differing diameters.

Still other benefits and advantages of the invention will become apparent to those skilled in the art to which it pertains upon a reading and understanding of the following detailed specification.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
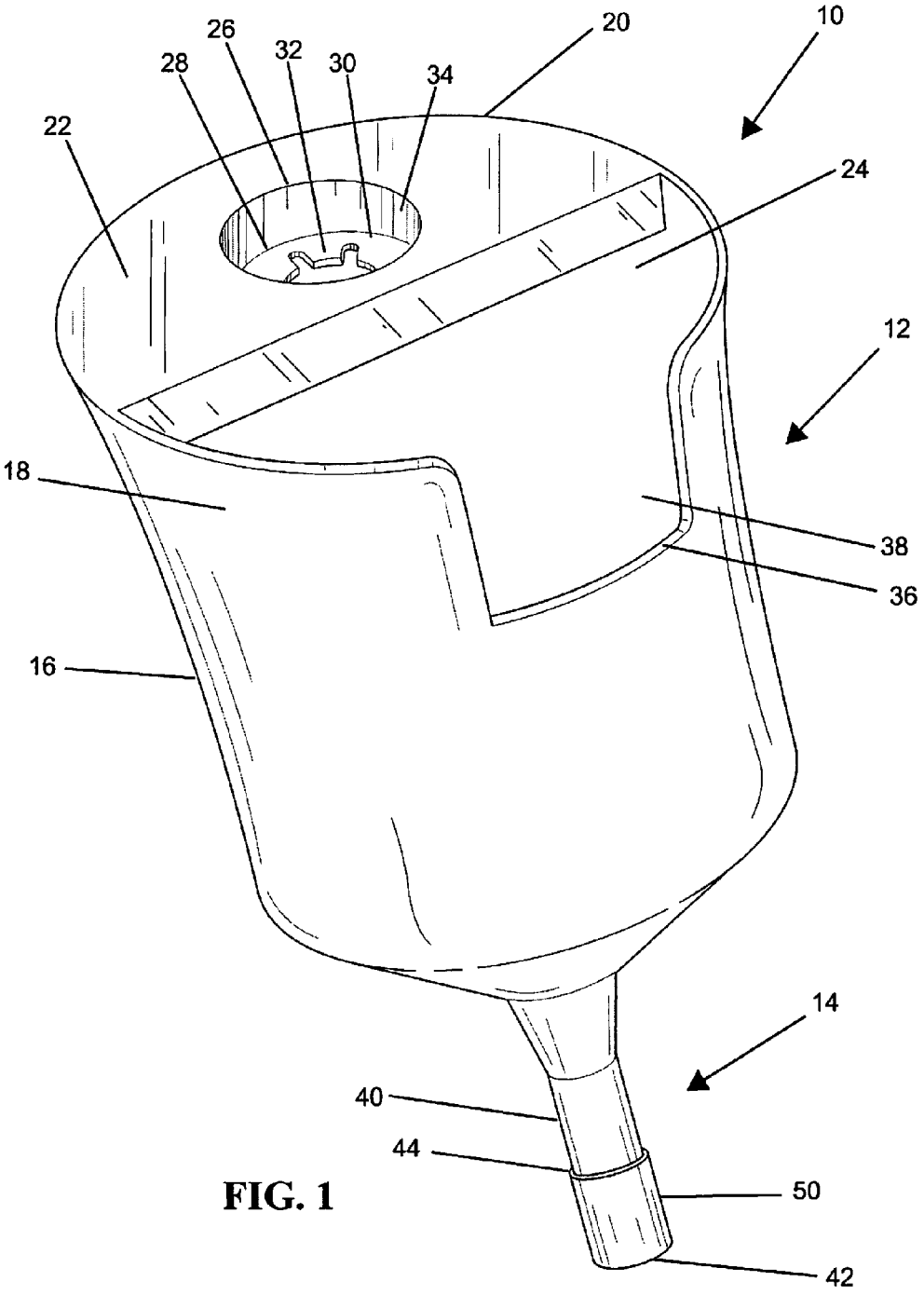
FIG. 1 is a perspective view of a version of the present invention.

Referring now to the drawings wherein the showings are only for purposes of illustrating a preferred version of the invention and not for purposes of limiting the same.

The following detailed description is of the best currently contemplated modes of carrying out exemplary versions of the invention. The description is not to be taken in the limiting sense, but is made merely for the purpose of illustrating the general principles of the invention, since the scope of the invention is best defined by the appended claims.

Various inventive features are described below that can each be used independently of one another or in combination with other features.

The invention relates to a funnel that assists with accurately and efficiently transferring fluids from one or more source containers to a receiving container. The funnel is easily inserted into a receiving container which has the ability to securely hold one or more inverted source containers in the inverted position without the assistance of a user.

With reference now to the drawings, and in particular to FIG. 1-FIG. 8 thereof, a new funnel embodying the principles and concepts of the present invention and generally designated by the reference numeral 10 will be disclosed. In the version, funnel 10 comprises a body portion 12 for receiving fluids from one or more source containers and a lower distribution portion 14 for distributing the fluid from the body portion 12 to a receiving container.

In the version, the body portion 12 comprises a base container 16 with an outer surface 18, and a receiving platform 20. The base container 16 is substantially in the shape of a bucket or a cylinder with a sufficient width to receive and hold liquid poured from a source container such as a quart of oil or conventional gas can. The receiving platform 20 is a substantially flat surface which partially extends above the top of the base container 16 forming an upper opening 24. The receiving platform 20 can be positioned horizontally or at an angle R (FIG. 8) relative to the base container 16 and outer surface 18. Preferably, receiving platform 20 is substantially horizontal or at an angle R of near 10 degrees from the horizontal.

Figure 6:
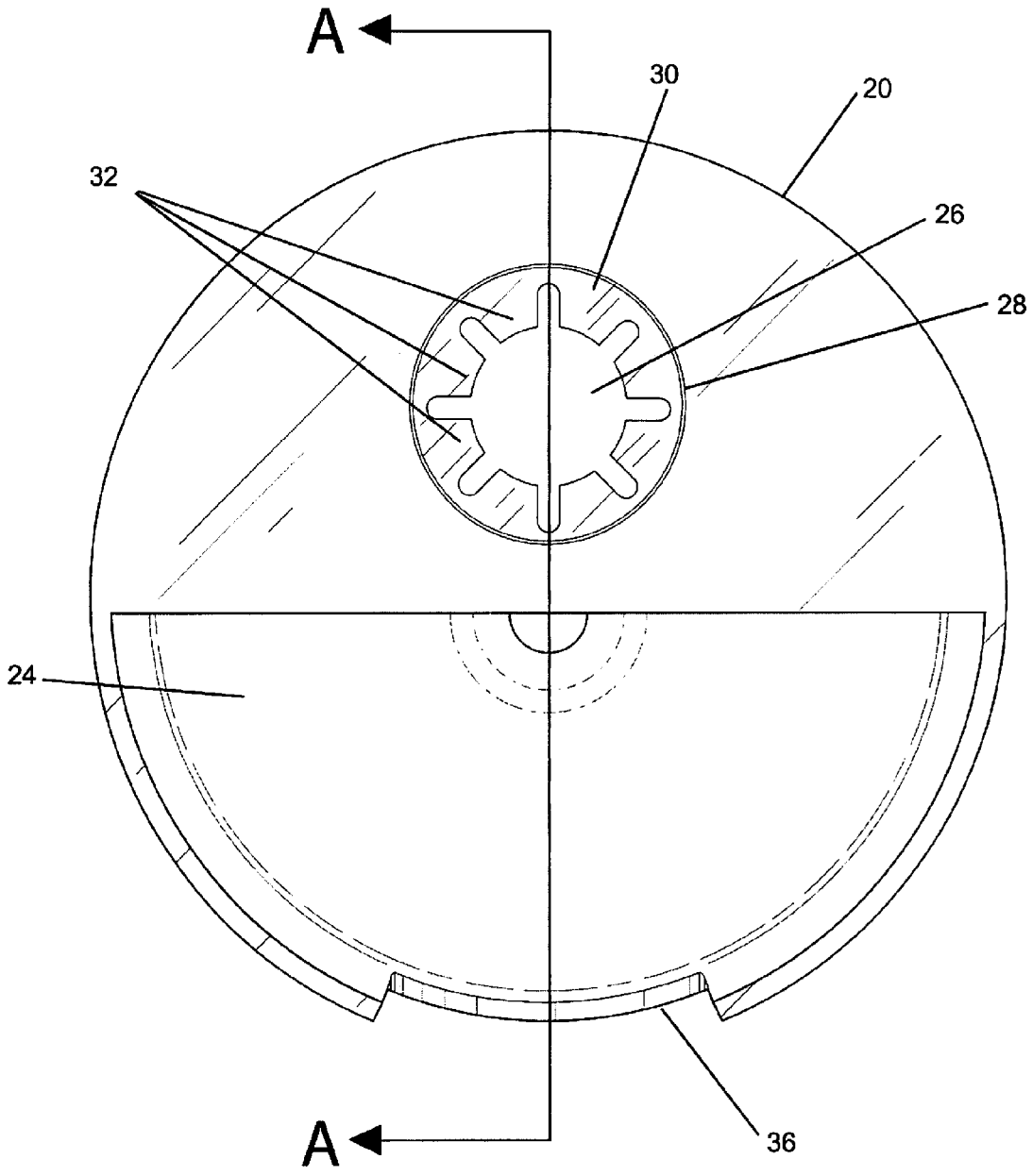
FIG. 6 is a top plan view of the version shown in FIG. 1.
Figure 7:
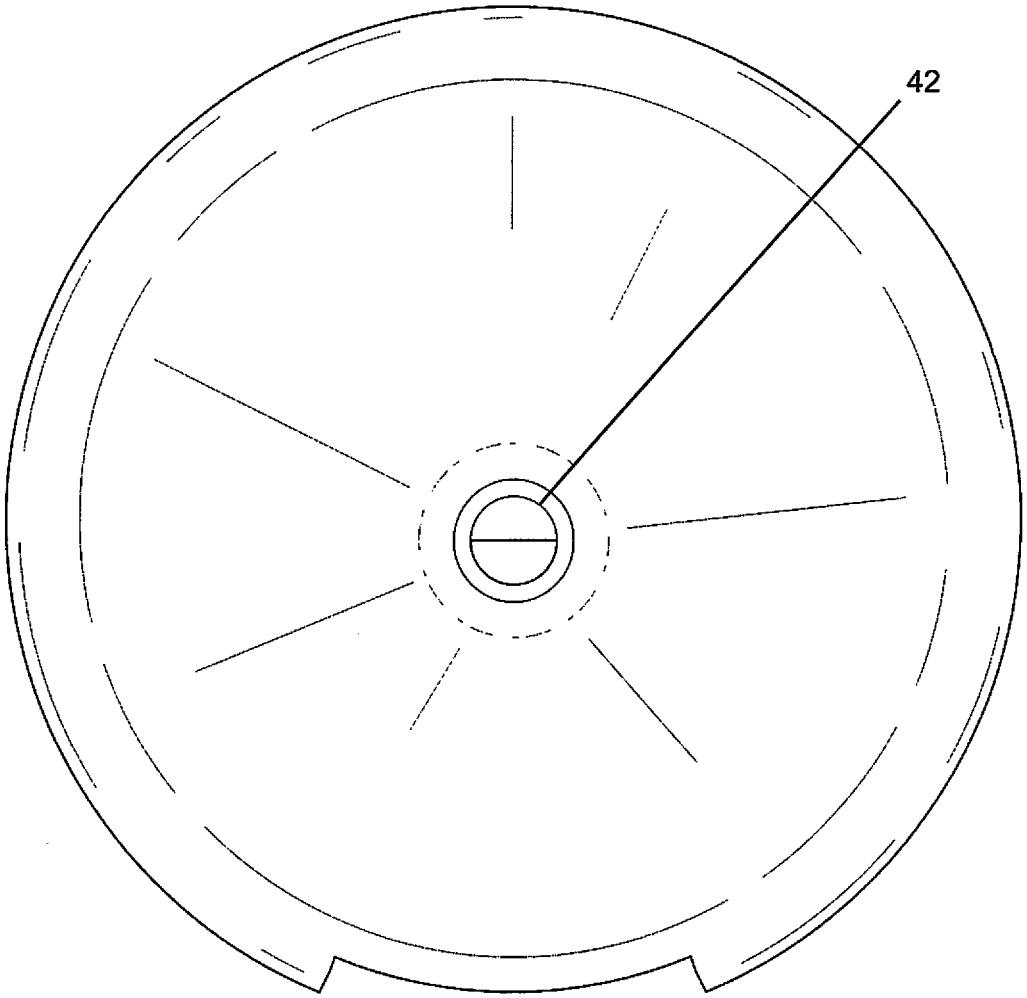
FIG. 7 is a bottom plan view of the version show in FIG. 1.

As depicted in FIG. 1 and FIG. 6, the receiving platform 20 comprises a circular aperture 26. The circular aperture 26 has a perimeter 28 which is adapted to receive and hold the neck portion of an inverted source container such as a conventional quart of oil. Moreover, the circular aperture 26 may have a means for gripping the neck portion of an inverted source container 30. In the version 10, the means for gripping the neck portion of an inverted source container 30 is a plurality of independently flexible gripping tabs 32 positioned around the perimeter 28 of the circular aperture 26. The plurality of independently flexible gripping tabs 32 are flexible in nature in order to receive and grip the neck portion of the source container and may be made of plastic, rubber, or any other sufficiently flexible material. Moreover, the circular aperture 26 can be manufactured in varying widths to accommodate various sized pour spouts.

Figure 2:
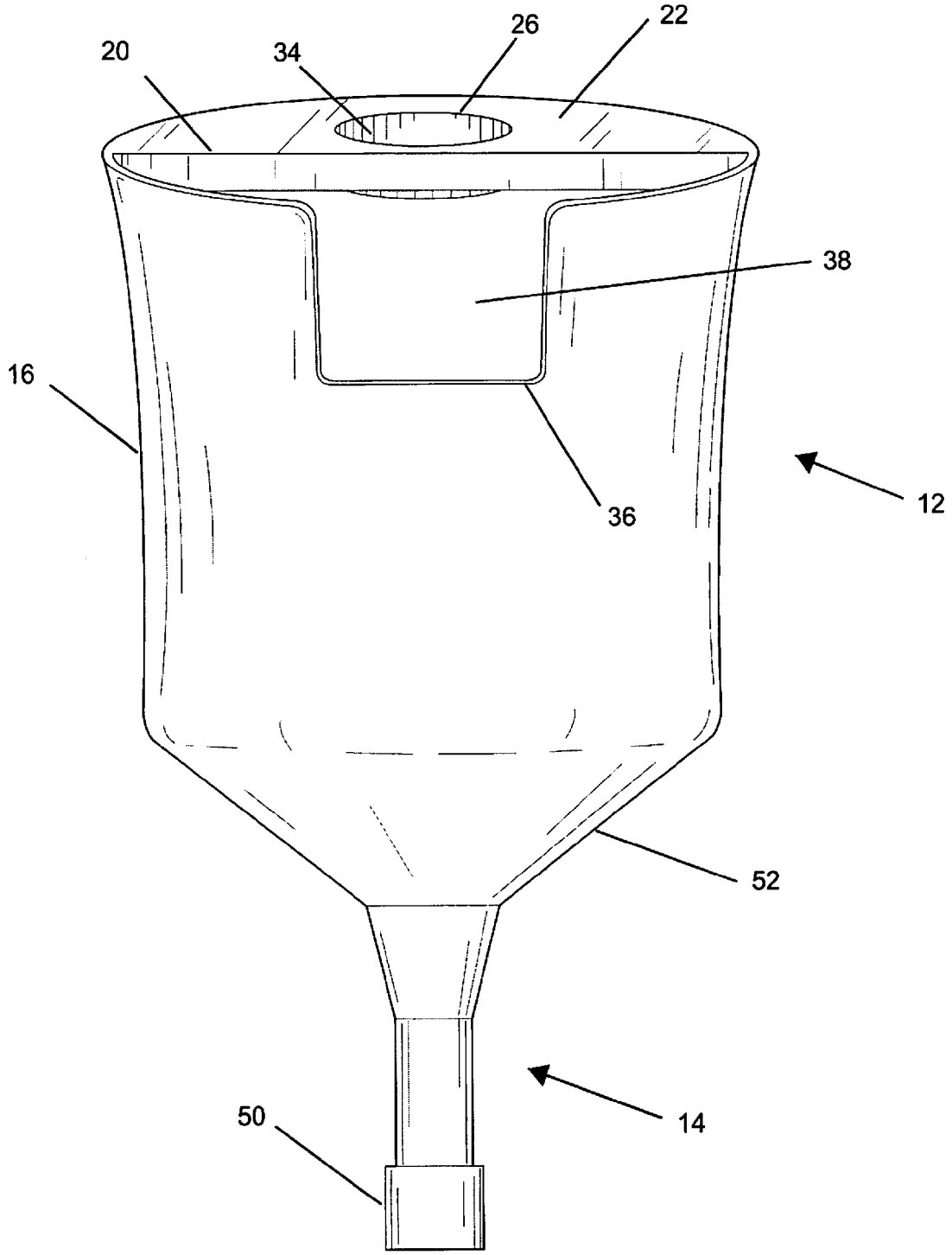
FIG. 2 is a front elevation view of the version shown in FIG. 1.
Figure 3:
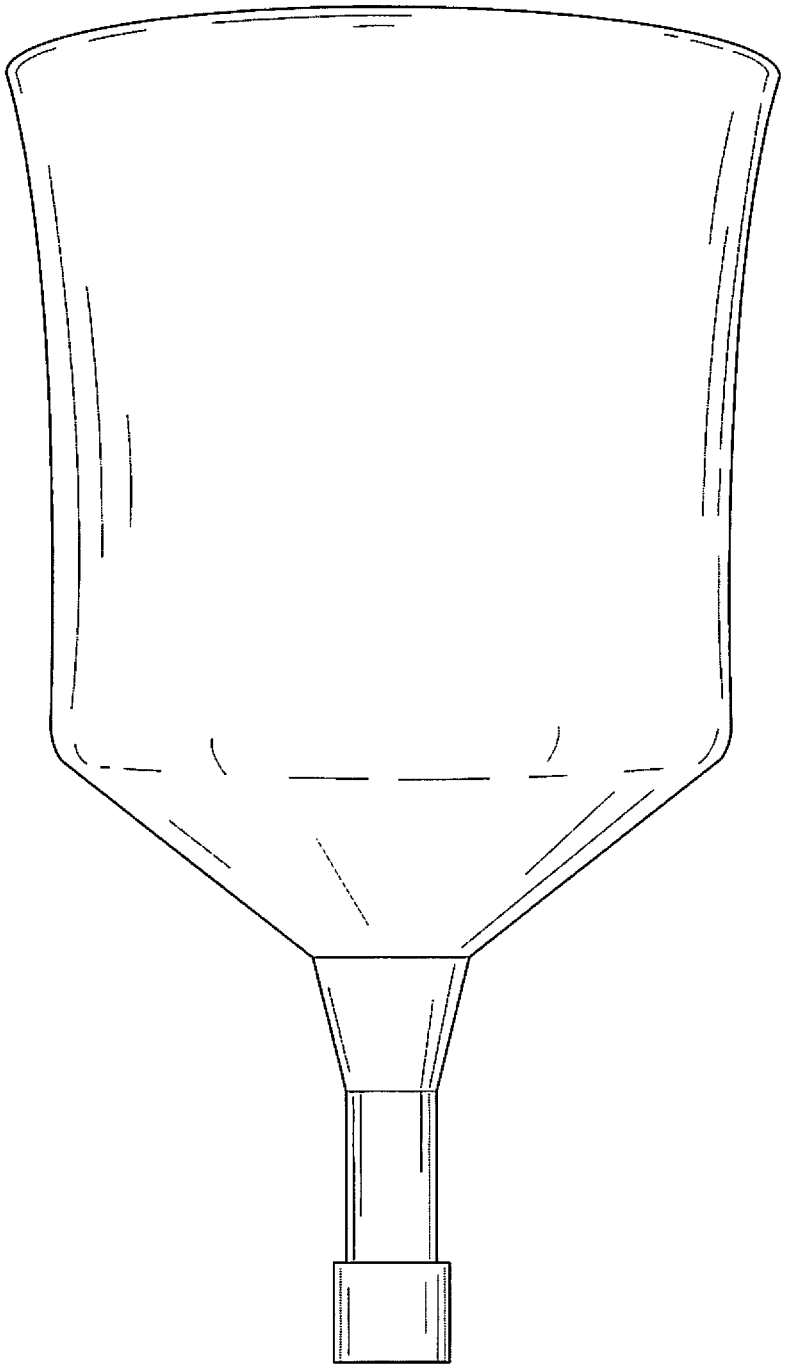
FIG. 3 is a rear elevation view of the version shown in FIG. 1.
Figure 4:
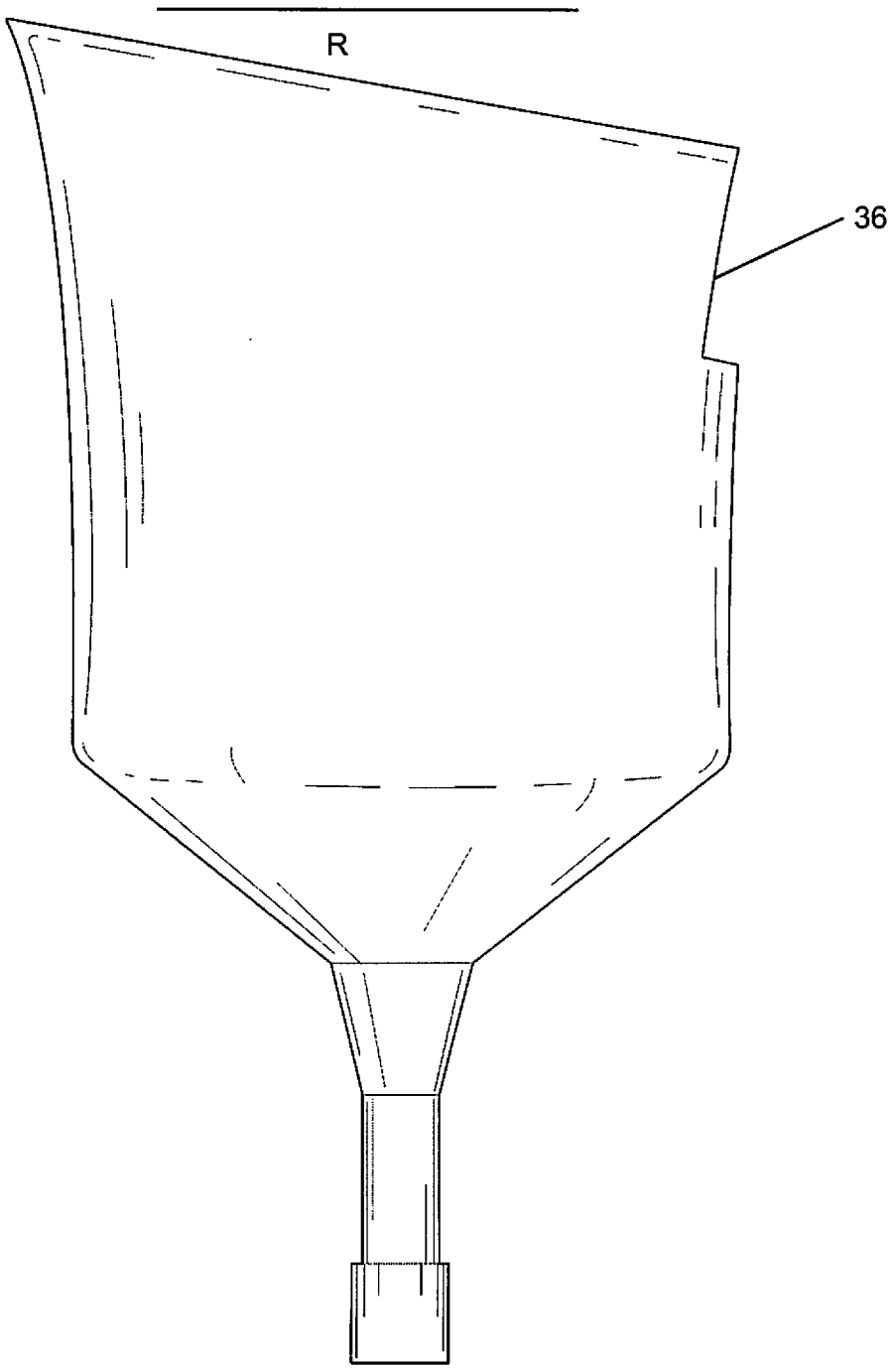
FIG. 4 is a left side elevation view of the version shown in FIG. 1.
Figure 5:
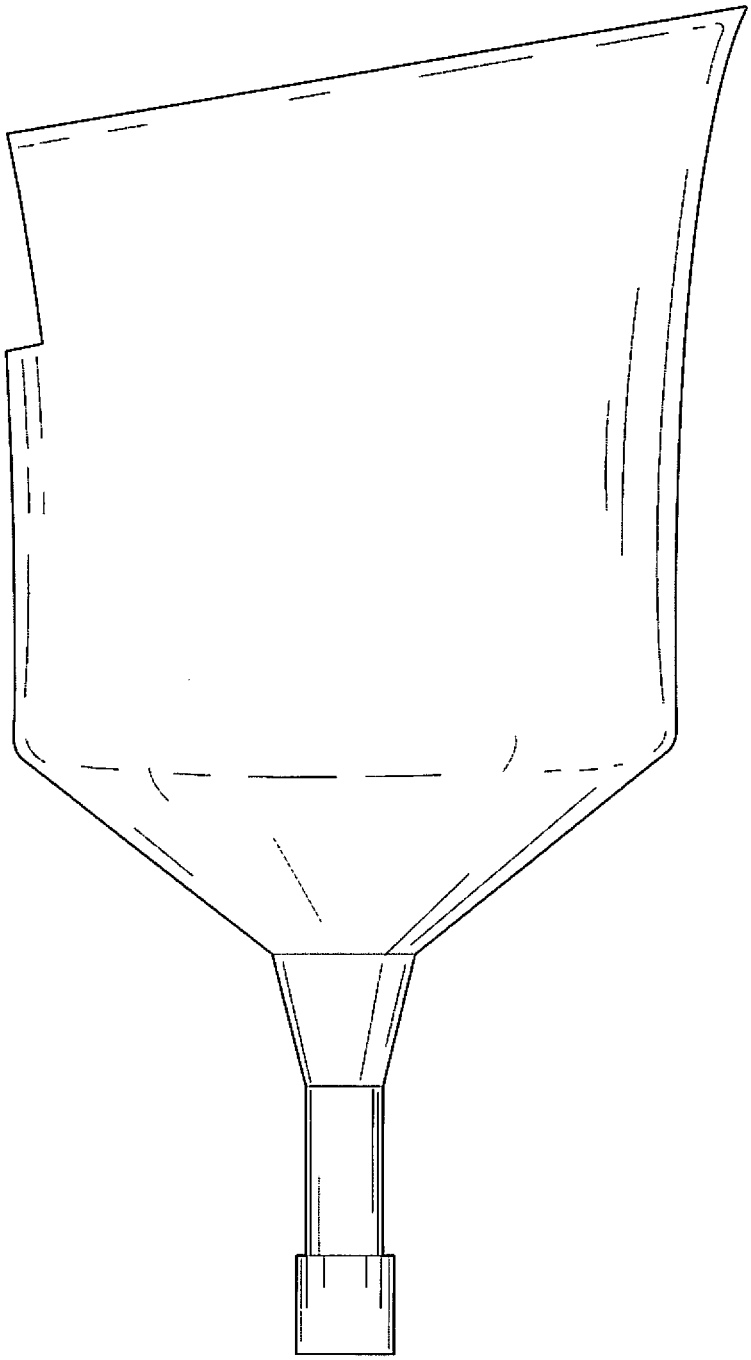
FIG. 5 is a right side elevation view of the version shown in FIG. 1.
Figure 8:
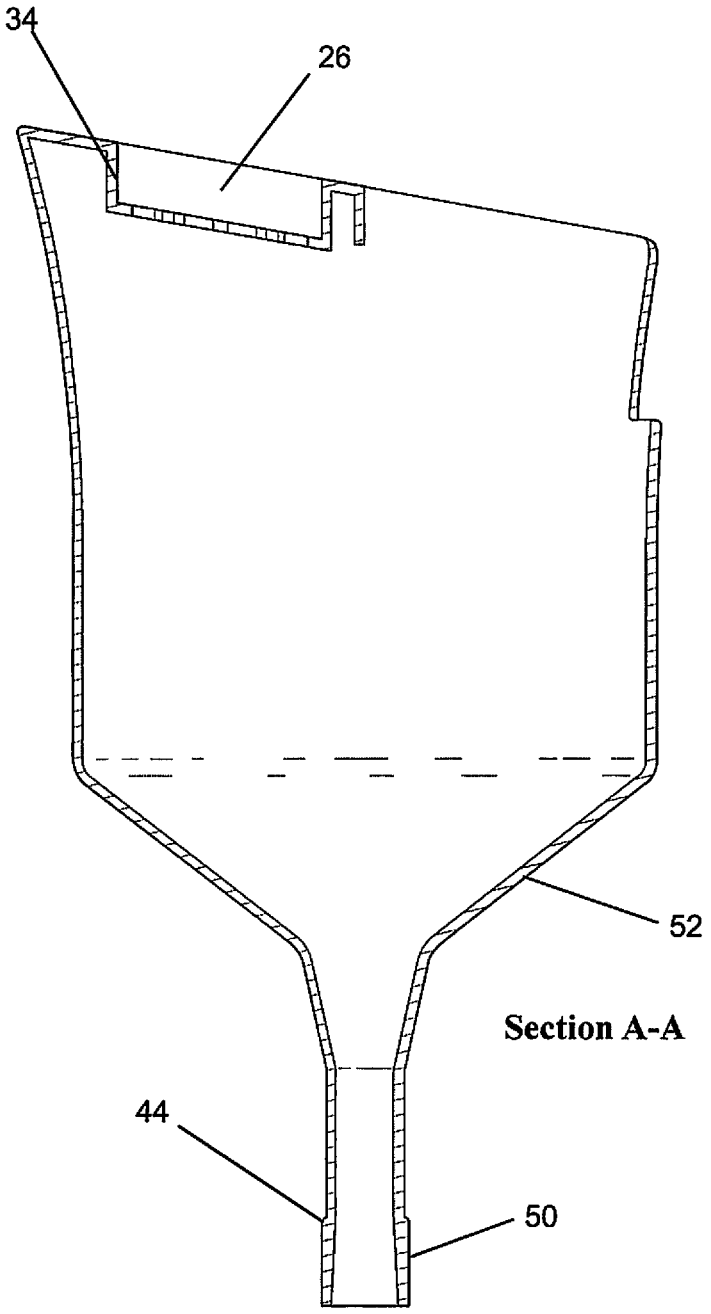
FIG. 8 is a cross-sectional view of the version shown in FIG. 1, taken along section line A of FIG. 6.

Moreover, with specific reference to FIG. 1, FIG. 2 and FIG. 8, funnel 10 optionally further comprises a cylindrical wall 34 that extends perpendicularly above and around the means for gripping the neck portion of an inverted source container 30. The cylindrical wall 34 assists in guiding the neck portion of the inverted source container into the means for gripping the neck portion of an inverted source container 30 and may further provide support to the source container while in the engaged position. In alternative versions, the means for gripping the neck portion of an inverted source container 30 can be recessed below or level with the upper surface 22 of the receiving platform 20.

As depicted in the figures, funnel 10 further provides a gap 36 within the frontal outer surface 18 of the base container 16. The gap 36 merges with the upper opening 24 forming a slot 38 for inserting and seating an additional inverted source container or for providing a larger opening for receiving poured fluid from a source container such as a gas can. This provides the user with the ability to transfer fluids from more than one source container simultaneously without external or manual assistance by the user.

As more specifically illustrated in FIG. 1 and FIG. 8, the version of the invention further comprises a lower distribution portion 14. The lower distribution portion 14 has an elongated tubular neck portion 40 and a discharge end 42. The elongated tubular neck portion 40 has an encompassing external ledge 44 near the discharge end 42 for gripping and catching on the internal surfaces of a receiving container such as on the inner ledge of an oil port connected to an engine oil reservoir.

In the depicted version 10, the encompassing external ledge 44 is created by the elongated tubular neck portion 40 having an upper diameter 46 and a larger lower diameter 48. The lower diameter 48 defines a cylindrical nozzle 50.

Optionally, the funnel 10, may further comprise elements that assist in guiding the fluid into the elongated tubular neck portion for discharge. As depicted, funnel 10 further comprises a conical middle portion 52 and a tapered spigot 54. The conical middle portion 52 extends between the body portion 12 to the tapered spigot 54. The spigot 54 extends between the conical middle portion 52 and the elongated tubular neck portion 40. In addition to assisting in funneling the fluid, the conical middle portion 52 helps support the funnel while seated on and within a filler opening of a receiving container.

Figure 9:
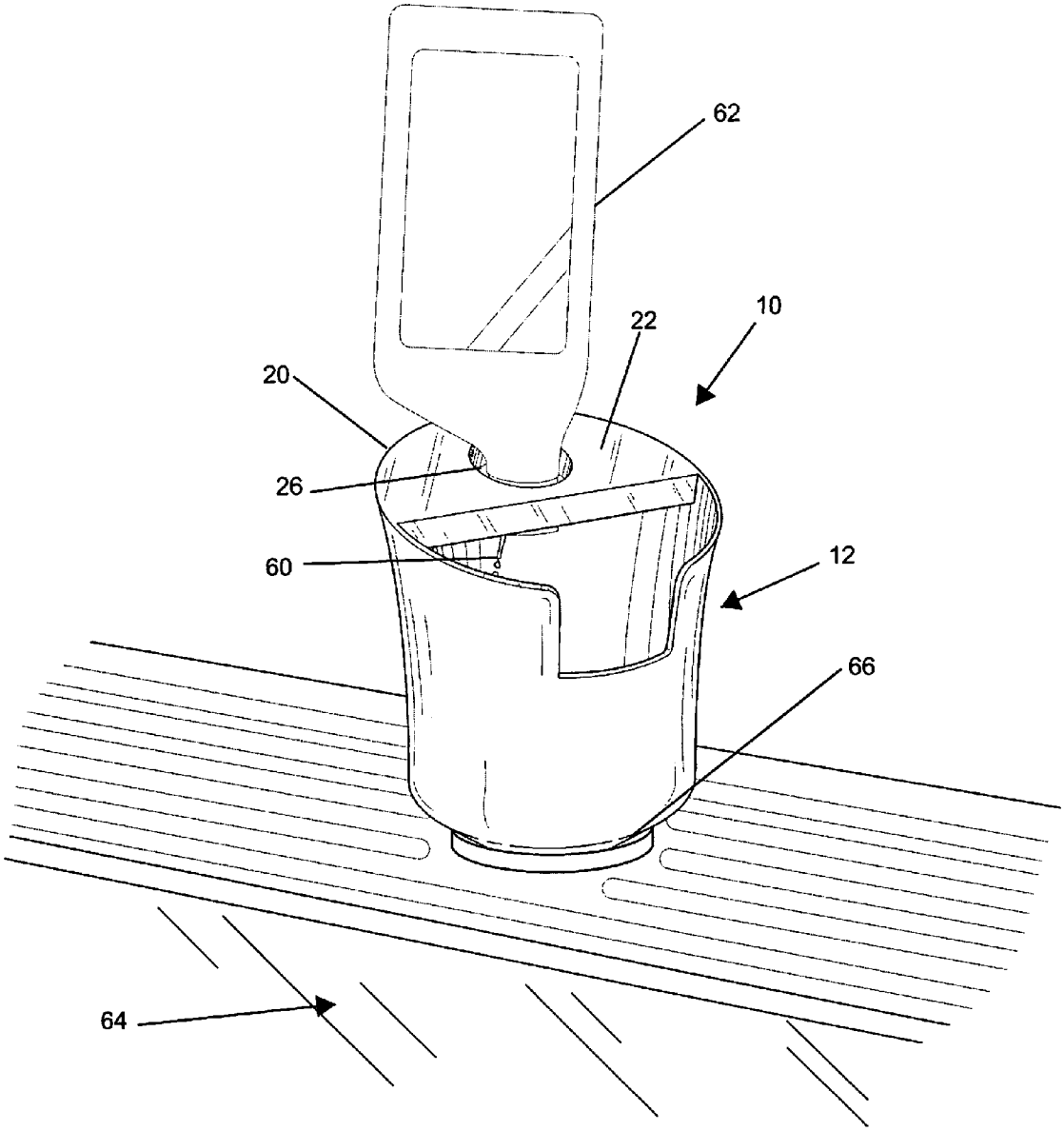
FIG. 9 is a perspective view of an exemplary use of the version shown in FIG. 1 showing an inverted source container inserted into the circular aperture in the engaged position.

FIG. 9-FIG. 12 illustrate how the funnel 10 is utilized in order to transfer oil 60 from one or more standard sized quart oil containers 62 into a receiving container or oil reservoir 64 via an oil fill port 66. Firstly, as illustrated in FIG. 9, the lower distribution portion 14 of the funnel 10 is inserted into the oil filler port 66 and firmly seated into place. The funnel 10 is primarily supported by the conical middle portion 52. Once the funnel 10 is seated, a quart of oil 62 or a source container is inverted and the neck portion 68 is inserted into the circular aperture 26 having the plurality of independently flexible gripping tabs 32 guided by the cylindrical wall 34. As the neck of the inverted quart of oil 62 moves down through the circular aperture 26, the plurality of independently flexible gripping tabs 32 flex downward in order to receive and provide space for the neck of the inverted quart of oil 62. As the plurality of independently flexible gripping tabs 32 flex downward, a resistance is created which applies a gripping action upon the neck portion 68 of the inverted quart of oil 62. At this point the quart of oil 62 is in the engaged position and the oil 60 begins to freely flow into the body portion 12 of the funnel 10 which fills the oil reservoir 64. This provides hands free operation of the funnel 10 allowing the user to simultaneously achieve other tasks while being ensured that the oil 60 is not spilled, yet efficiently and reliably transferred to the oil reservoir 64 or receiving container. When the quart of oil 62 is empty, it is then removed by pulling the neck portion 68 up and out of the circular aperture 26; therefore being released by the plurality of independently flexible gripping tabs 32.

Figure 10:
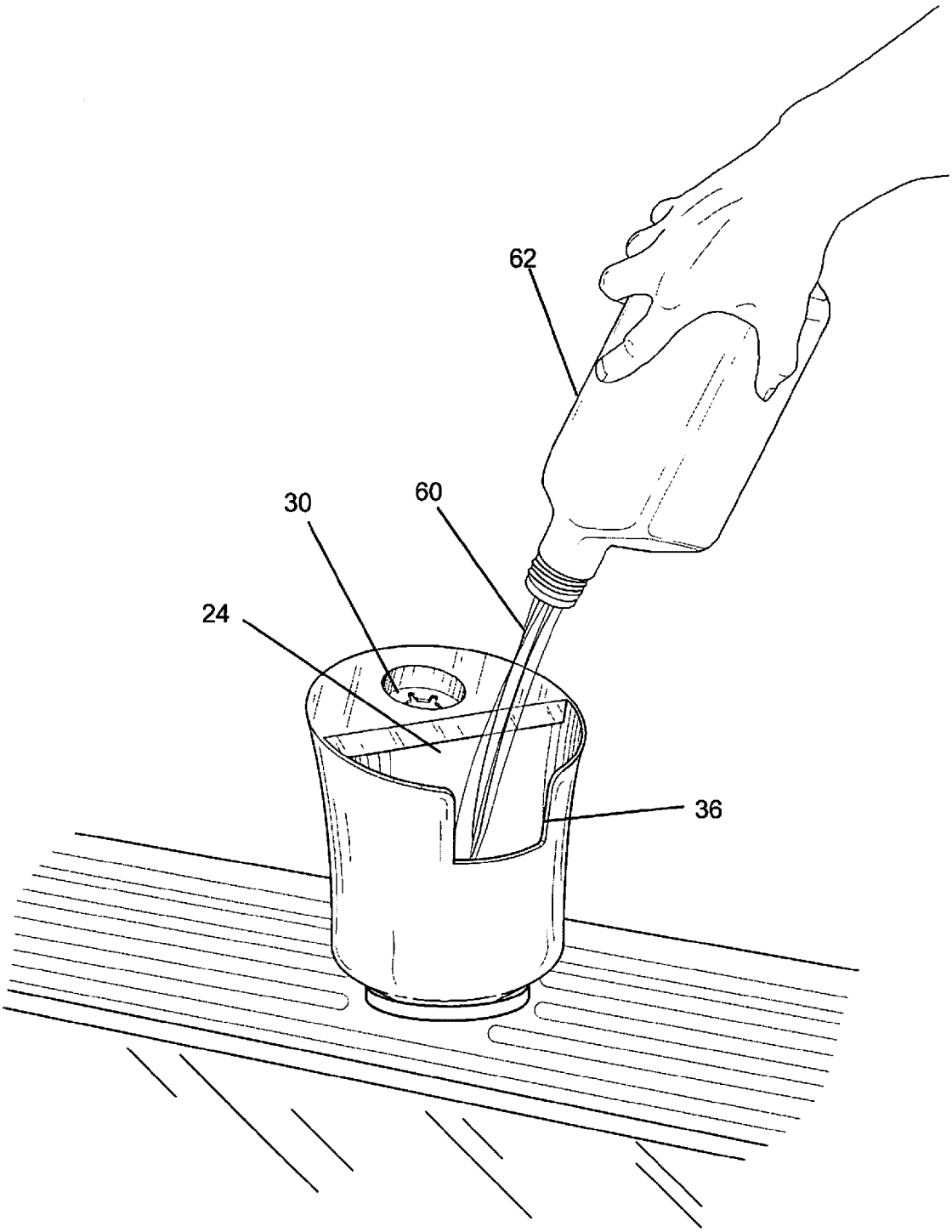
FIG. 10 is a perspective view of an exemplary use of the version shown in FIG. 1 showing a user manually pouring fluid from a source container.
Figure 11:
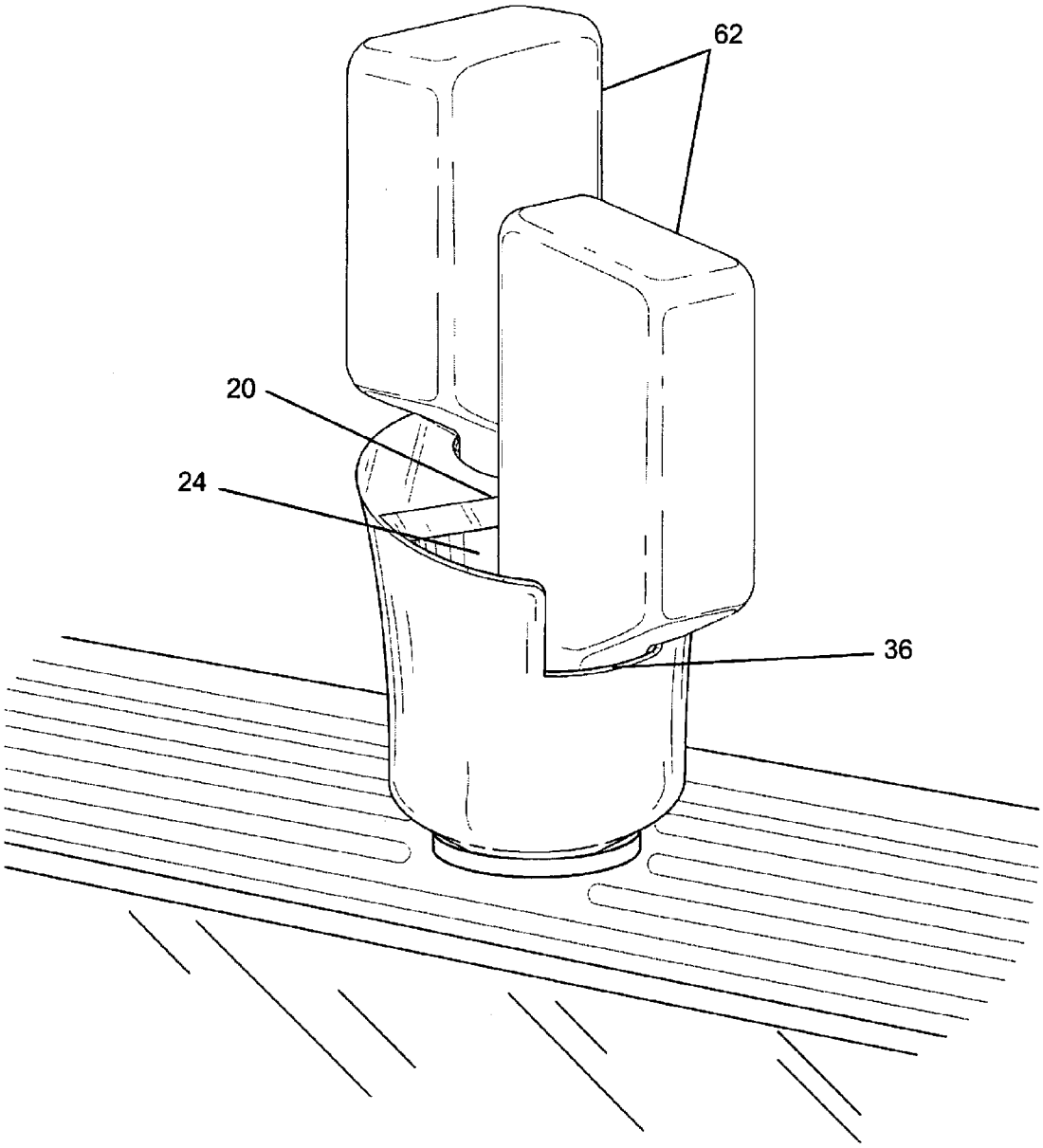
FIG. 11 is a perspective view of an exemplary use of the version shown in FIG. 1 showing the funnel simultaneously receiving liquid from two source containers.

As depicted in FIG. 10 and FIG. 11, additional quarts of oil 62 can be either poured directly into the funnel 10 by hand (FIG. 10) or another inverted quart of oil 62 can be seated into the slot 38 (FIG. 11) while being laterally supported by the receiving platform 20. This provides the user with the option of seating one or more quarts of oil within the funnel.

Figure 12:
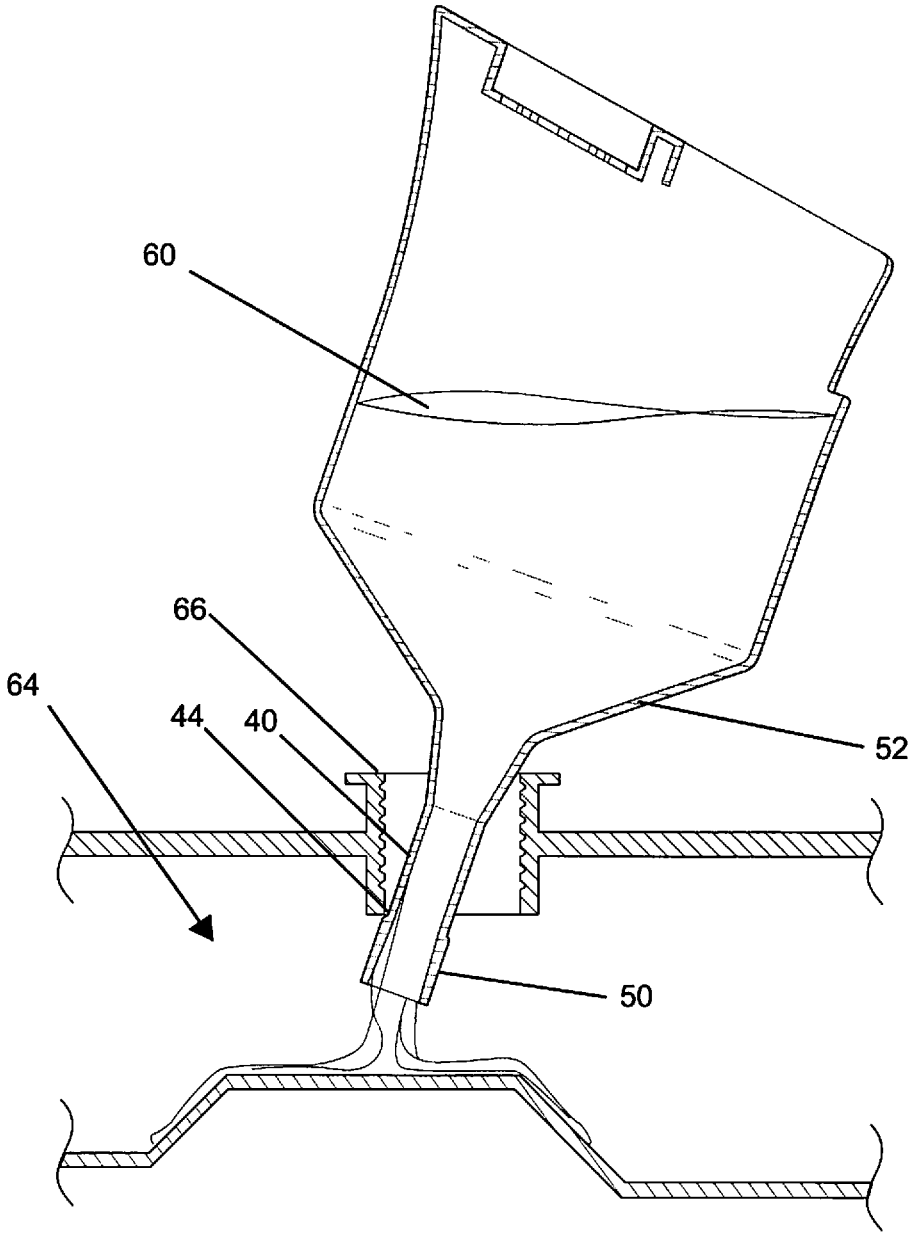
FIG. 12 is a cross-sectional view of an exemplary use of the version shown in FIG. 1 depicting the funnel inserted into a receiving container.

FIG. 12 is a cross-sectional view of an exemplary use of the funnel 10 which depicts the lower distribution portion 14 inserted into the oil filler port 66 of the oil reservoir 64. The encompassing external ledge 44 locks the funnel 10 into place by being positioned so that it catches and grips on the internal surfaces of the receiving container or the inner ledge 70 of an oil filler port 66.

The present invention can be made in any manner and of any material chosen with sound engineering judgment. Preferably, materials will be strong, lightweight, long lasting, economic, and ergonomic, such as a light weight plastic with sufficient density.

The previously described versions of the present invention have many advantages, including providing a funnel that reduces the time required to fill the receiving container by having the ability to hold and dispense one or more source containers at the same time—thus providing a hands free operation of the funnel.

The invention does not require that all the advantageous features be incorporated into every version of the invention.

Although preferred versions of the invention have been described in considerable detail, other versions of the invention are possible.

All the features disclosed in this specification (including and accompanying claims, abstract, and drawings) may be replaced by alternative features serving the same, equivalent or similar purpose unless expressly stated otherwise. Thus, unless stated otherwise, each feature disclosed is one example only of a generic series of equivalent or similar features.

What is claimed is:

1. A funnel for transferring fluids from one or more source containers to a receiving container, each source container having a neck portion, the funnel comprising:

(a) a body portion for receiving the fluids comprising a sidewall, a top portion, a receiving platform, and an upper opening, the receiving platform integrally formed at and partially extending across the top portion and defining the upper opening in conjunction with the body portion sidewall, the upper opening configured to receive freely poured fluid from a source container, and the receiving platform comprising a circular aperture with a perimeter adapted to receive and hold the neck portion of the source container, wherein the source container is held securely in the inverted position;

(b) a gap integrated within the side wall merging upward with the upper opening forming a slot for inserting and seating an inverted source container and further providing an opening for receiving a freely poured fluid from a container; and (c) a lower distribution portion operably connected to the body portion for delivering fluid to the receiving container.

2. The funnel of claim 1, wherein the circular aperture comprises a plurality of independently flexible gripping tabs positioned around the perimeter of the circular aperture, whereby the plurality of independently flexible gripping tabs flex in order to receive and grip the neck portion of the container.

3. The funnel of claim 2, further comprising a cylindrical wall that extends perpendicularly above and around the plurality of independently flexible gripping tabs, whereby the cylindrical wall assists in guiding the neck portion of the inverted source container into the plurality of independently flexible gripping tabs and provides support to the funnel.

4. The funnel of claim 3, wherein the lower distribution portion comprises an elongated tubular neck having a discharge end and an encompassing external ledge near the discharge end for gripping and catching on the internal surfaces of the receiving container.

5. The funnel of claim 1, wherein the lower distribution portion comprises an elongated tubular neck having a discharge end and an encompassing external ledge near the discharge end for gripping and catching on the internal surfaces of the receiving container.

* * * * *